US005595002A

United States Patent [19]

Slepian et al.

[11] Patent Number: 5,595,002

[45] Date of Patent: Jan. 21, 1997

[54] STABILIZING GRID WEDGE SYSTEM FOR PROVIDING MOTION CONTROL AND CUSHIONING

[75] Inventors: Neil R. Slepian, Durham, N.H.; Michael P. Kirk, Salem; Joseph Hamill, Florence, both of Mass.

[73] Assignee: Hyde Athletic Industries, Inc., Peabody, Mass.

[21] Appl. No.: 349,405

[22] Filed: Dec. 5, 1994

[51] Int. Cl.[6] ..... A43B 13/28; A43B 21/26; A43B 5/00

[52] U.S. Cl. ..... 36/27; 36/35 R; 36/114

[58] Field of Search ..... 36/30 R, 31, 28, 36/114, 27, 35 R, 143, 144

[56] References Cited

U.S. PATENT DOCUMENTS

| | | | |
|---|---|---|---|
| 2,001,821 | 5/1935 | Everston . | |
| 2,677,906 | 5/1954 | Reed . | |
| 3,724,106 | 4/1973 | Magidson . | |
| 3,738,373 | 6/1973 | Glancy | 36/144 |
| 4,180,924 | 1/1980 | Subotnick . | |
| 4,297,797 | 11/1981 | Meyers . | |
| 4,364,188 | 12/1982 | Turner et al. | 36/30 R |
| 4,364,189 | 12/1982 | Bates . | |
| 4,445,283 | 5/1984 | Meyers . | |
| 4,506,462 | 3/1985 | Cavanagh . | |
| 4,547,979 | 10/1985 | Harada et al. | 36/31 |
| 4,624,061 | 11/1986 | Wezel et al. | 36/31 |
| 4,627,177 | 12/1986 | Meyers . | |
| 4,680,875 | 7/1987 | Danieli | 36/31 |
| 4,694,591 | 9/1987 | Banich et al. | 36/31 |
| 4,730,402 | 3/1988 | Norton et al. | 36/30 R |
| 4,890,397 | 1/1990 | Harada et al. | 36/30 R |
| 5,070,629 | 12/1991 | Graham et al. . | |
| 5,402,588 | 4/1995 | Graham et al. | 36/27 |

FOREIGN PATENT DOCUMENTS

| | | | |
|---|---|---|---|
| 1367968 | 1/1988 | U.S.S.R. | 36/30 R |

*Primary Examiner*—B. Dayoan
*Attorney, Agent, or Firm*—Wolf, Greenfield & Sacks, P.C.

[57] ABSTRACT

A stabilizing system providing motion control and cushioning. The stabilizing system is locating in the heel assembly and has at least one grid assembly extending laterally over at least a portion of the shoe construction from the medial to the lateral side in the heel region, and a cushioning wedge supporting the grid assembly. The cushioning wedge is thicker along the lateral portion than the medial portion and has greater compressibility than the other components in vertical alignment therewith whereby the medial portion is less compressible than the lateral portion thereby mitigating the likelihood of overpronation.

19 Claims, 3 Drawing Sheets

STABILIZING GRID WEDGE SYSTEM FOR PROVIDING MOTION CONTROL AND CUSHIONING

SUBJECT MATTER OF THE INVENTION

1. Field of the Invention

The present invention relates to a shoe construction and more particularly to a shoe construction having means for stabilizing the foot of a runner by imparting motion control and cushioning.

2. Background of the Invention

Biomechanics has taught that the running gait cycle begins with the heel strike, that is when the foot first impacts the ground. The foot first strikes the ground along a lateral portion of the heel in a supinated position. As the gait cycle continues, the foot rotates substantially transverse or inward through the midstance position toward the medial portion of the foot. When the foot moves to the medial portion, it is in the pronated phase.

Ability to control the rearfoot through the gait cycle is important. Studies have shown that overpronation, which occurs when the foot rotates too far inward, may result in potentially serious injuries. One author noted that "[r]earfoot control can be defined in running shoes as the relative ability of a shoe to limit the amount and or rate of subtalar joint pronation immediately following foot strike. A normal amount of pronation is helpful in decreasing peak pressures experienced by the foot and leg, but excessive pronation can be harmful if it produces increased internal or medial leg rotation causing stress in various bones and soft tissue." Cheskin, *The Complete Handbook of Athletic Footwear* 267 (1987).

Avoiding such injuries may be accomplished through a variety of constructions. The basic concept of such constructions is to have a softer cushioning material on the outside or lateral portion of the shoe in comparison with a harder material on the inside or medial portion of the shoe. Having different material compressibilities between the medial and lateral portions is essential to providing rearfoot control to help overpronation. A prior art method to accomplish this includes use of discrete materials within the midsole region having different compressibility characteristics.

None of the prior art systems, however, satisfactorily achieve the combination of cushioning and motion control. Moreover, the prior art does not sufficiently slow the rate of rotation to mitigate the likelihood of overpronation.

SUMMARY OF THE PRESENT INVENTION

It is the object of the present invention to provide a stabilizing system which is a combination motion control and cushioning system.

It is another object of the present invention to provide an improved stabilizing system which is simple and inexpensive to manufacture.

It is still another object of the present invention to provide a stabilizing system which provides cushioning to the foot during heel strike and thereafter slows the rate of pronation through the gait cycle.

These and other objects of the present invention are accomplished by having a heel assembly with at least one grid assembly extending laterally over at least a portion of the shoe construction from the medial to the lateral side in the heel region, and a cushioning wedge supporting the grid assembly. The cushioning wedge has a thicker portion along the lateral portion than the medial portion and is also more compressible than the other components in vertical alignment therewith whereby the medial portion is less compressible than the lateral portion thereby mitigating the likelihood of overpronation.

These and other objects and features of the present invention will be better understood and appreciated from the following detailed description of one basic embodiment thereof, selected for the purpose of illustration and shown in the accompanying drawings, in which:

DETAILED DESCRIPTION OF THE INVENTION

Figure 1:
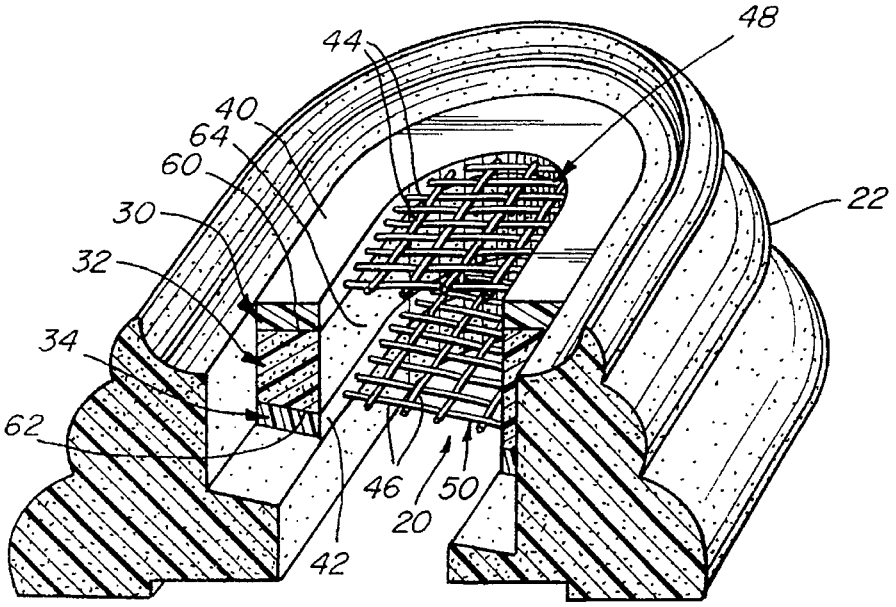
FIG. 1 is a perspective view of a cut away of selected components of a shoe construction illustrating the present invention.
Figure 2:
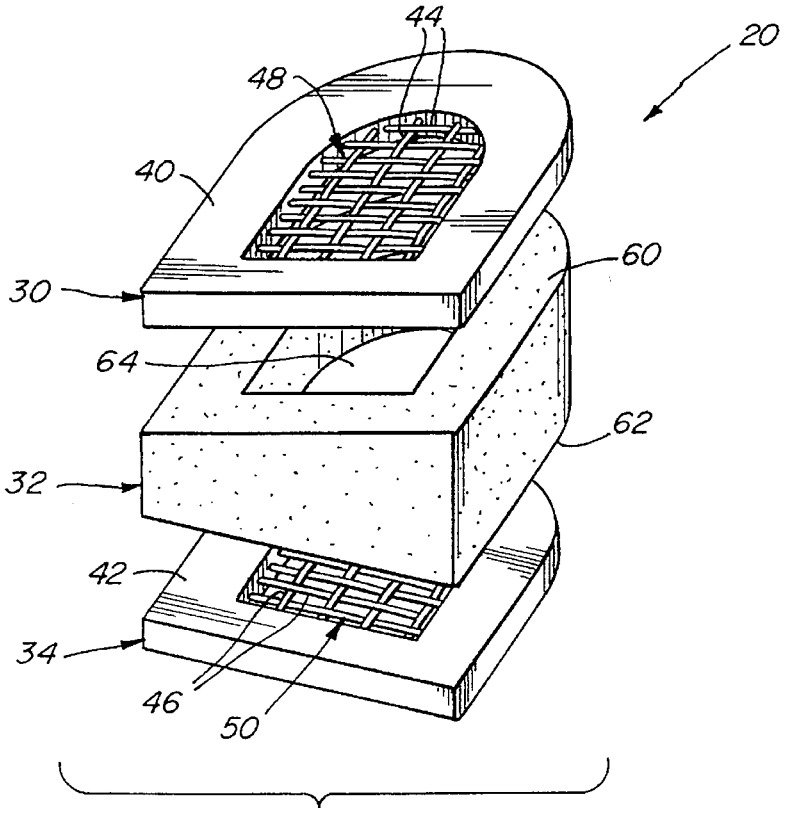
FIG. 2 is an exploded view of the present invention from a similar perspective as illustrated in FIG. 1.
Figure 5:
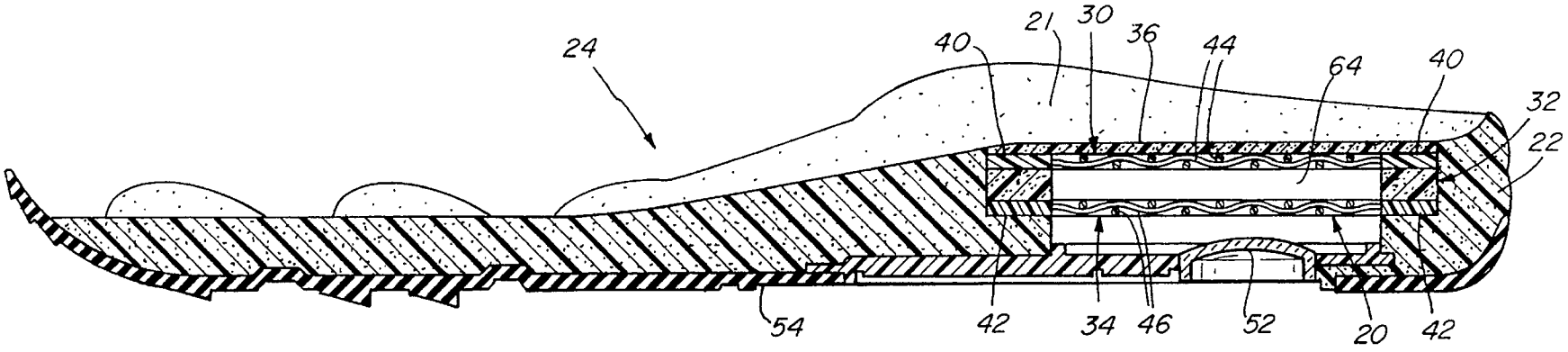
FIG. 5 is a cross-sectional view of the present invention taken along the lines 5—5 of FIG. 3.

The primary components comprising the stabilizing system 20 may generally be seen in FIGS. 1, 2, and 5. The system 20 is positioned in the heel region 21 of the midsole layer 22 of a standard shoe sole assembly 24 (FIG. 5). The stabilizing system 20 has three basic components, a first or top grid 30, a cushioning wedge 32, and a second or bottom grid 34. The preferred embodiment further has a cover 36 which is positioned above the top grid 30. The overall assembly 20, including cover 36, is preferably secured in vertical alignment by means known in the art such as cement or other securing-means.

The grids 30 and 34 are generally illustrated and described in U.S. Pat. No. 5,070,629, which issued Dec. 10, 1991, and which is incorporated herein by reference. That patent describes the grids 30 and 34 which, in the present system 20, are defined by peripheral flanges or frames 40 and 42, and a plurality of fibers 44 and 46, respectively. The fibers 44 and 46 may be of nylon, plastic, or some other suitable filament, which are molded into a structure resembling a net 48 and 50 positioned substantially in the plane of the frame 40 and 42.

Figure 4:
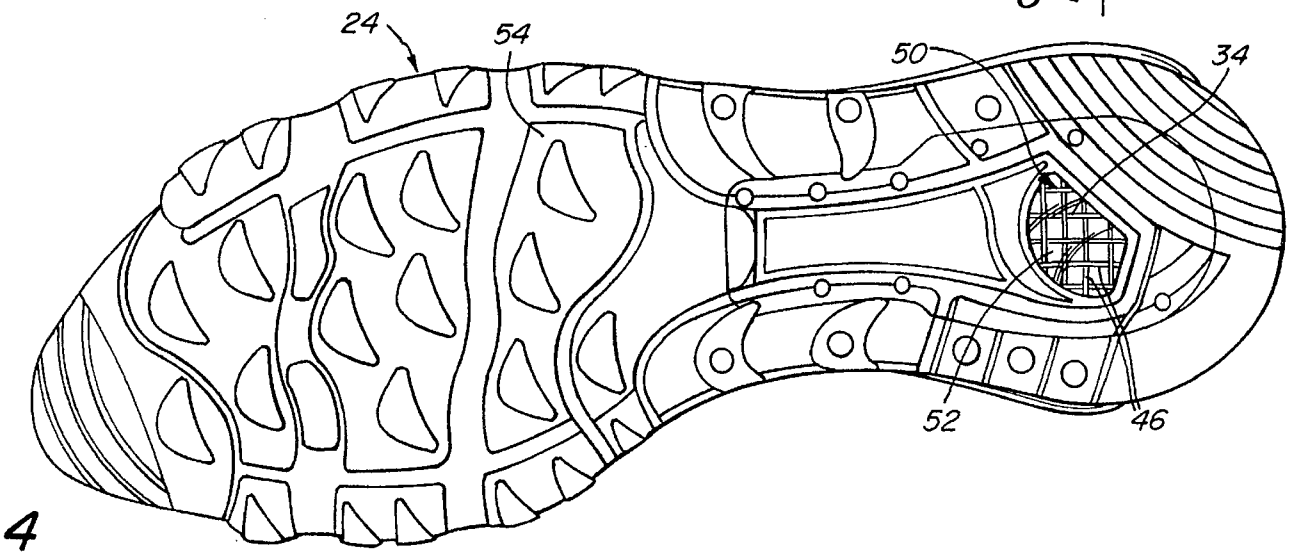
FIG. 4 is a bottom view illustrating a portion of the present invention.

In the preferred embodiment, the respective plurality of fibers 44 and 46 are vertically aligned in the sole assembly 24. A transparent, concave midsole dome 52 is secured to and extends upwardly through the sole 54. In this arrangement, the fibers 46 of the bottom grid 34 can be seen with the top fibers 44 in the background (FIG. 4). In another embodiment, the bottom grid 34 may be replaced with a structure only comprising the frame portion, that is, there would be no net 50 in this alternative embodiment. If such a replacement structure is used, then the net 48 of the top grid 30 will only be seen through the dome 52. The dome 52 in combination with a grid is the subject of U.S. patent application Ser. No. 07/659,874, filed Feb. 25, 1991, which is also incorporated herein by reference.

Figure 6:
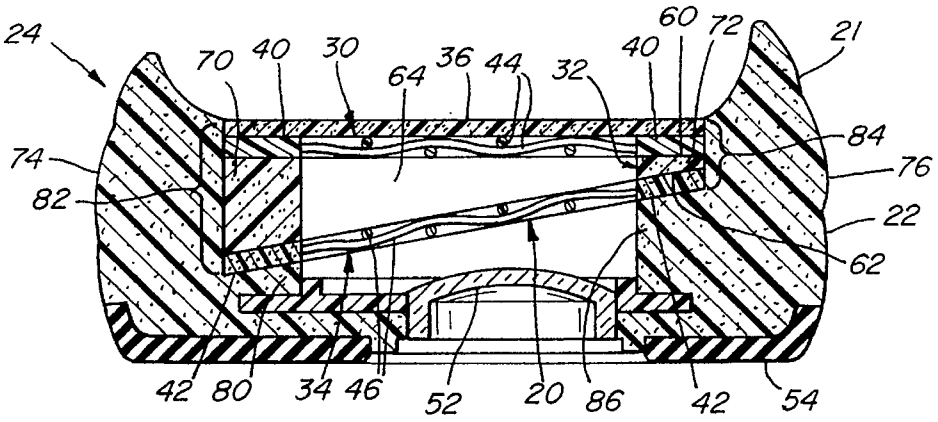
FIG. 6 is a cross-sectional view of the present invention taken along the lines 6—6 of FIG. 3.

A cushioning wedge 32 is positioned between the top and bottom grids 30 and 34. The wedge 32 has a sideways oriented V-shaped cross-section as seen in FIG. 6. The wedge top surface 60 lies in a horizontal plane and is parallel to and supports the frame 40 of the top grid 30, while the wedge bottom surface 62 is angled from the top surface 60 and lies in a plane parallel to and facing the upper surface of frame 42 of the bottom grid 34. Preferably, the angle formed by the top surface 60 and the bottom surface 62 is 10°, however, the angle may be in the range of approximately 5° to 20°. Thus, the cushioning wedge 32 has a thick side 70 and a thin side 72 (FIG. 6).

The cushioning wedge 32 has an open area 64 defined by its enclosing walls. The cushioning wedge 32 may be compressed by foot pressure on the net 48. When this occurs the net 48 deforms to conform to and cushion the heel. The net 48 may move downwardly into the open area 64 as it absorbs the force of the heel. The dimensions and alignment of the cushioning wedge 32 and grids 30 and 34 is such that the frames 40 and 42 of the respective grids 30 and 34 lie flush against the respective surfaces of the wedge 60 and 62. The cushioning wedge 32 does not contact either net 48 or 50. Moreover, the frame portion 42 of the bottom grid 34 supports the cushioning wedge 32 as downward force is imparted by the runner.

Figure 3:
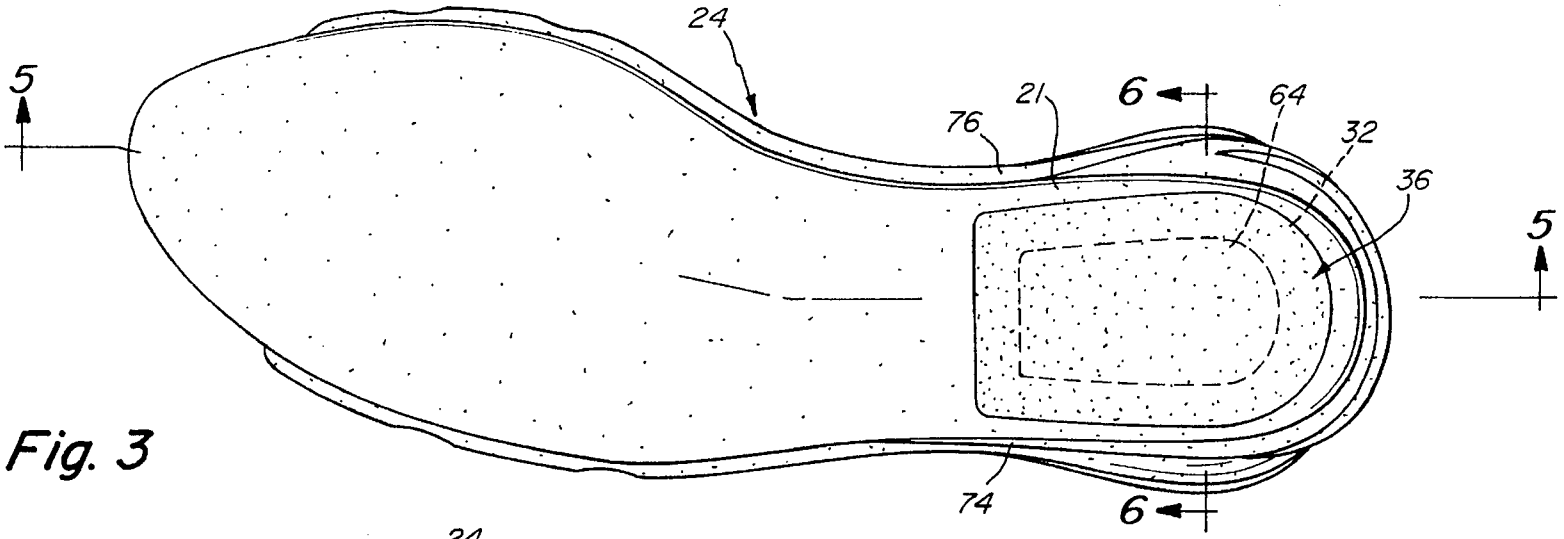
FIG. 3 is a top view of the present invention.

The stabilizing system 20 is oriented in the shoe sole assembly 24 with the thick side 70 on the lateral side 74 of the shoe sole assembly 24 and the thin side 72 on the medial side 76 (FIGS. 3 and 6). This orientation allows for the first strike through pronation to proceed from the thick side 70 to the thin side 72.

The combination of the materials which make up the lateral side of the heel region 21 and lateral side of the stabilizing system 20 is more compressible than the materials on the medial side of both the heel and the assembly 20. Since the thickness and compressibility of the cover 36 and grids 30 and 34 are the same on both sides, the compressibility of the lateral side 70 of the cushioning wedge 32 and the midsole 22 must be greater than the medial side 72 of the cushioning wedge 32 and the midsole 22. Obviously, the compressibility of the center portion is greatest because the open area 64 of the cushioning wedge 32 provides no resistance at all. As seen in FIG. 6, the midsole region 80 in vertical alignment below the lateral, thicker side 82 of the assembly 20 is smaller than the midsole region 86 below the thinner side 84 of the assembly 20. To maintain the greater cushioning characteristics of the lateral side in comparison with the medial side, the midsole material must be less compressible than the cushioning wedge material.

In the operation of the system, the initial, substantial cushioning of the foot during the first strike, which is on the lateral side 74, absorbs the initial force imparted by the runner. The gradual increase of the stiffness in the assembly 20 from the lateral to medial sides slows the rate of rotation of the foot thereby mitigating the likelihood of overpronation. Since the rotation of the foot is slowed down, the foot reaches maximum pronation at about fifty percent through the gait cycle as opposed to many other gait cycles where maximum pronation is reached at between 40 and 45 percent.

Among the dimensions and materials for use with the components are as follows.

The grids 30 and 34 have been described in U.S. Pat. No. 5,070,629. Preferably, the grids are made from a relatively non-compressible plastic, such as a polyester, including Hytrel®. The height of the grids is preferably 2.0 mm, while in the range of about 0.5 mm to 3.0 mm. The width of the grids is preferably 58 mm, while in the range of about 50 mm to 65 mm. The preferably grid length is 82 mm, which is in the range of approximately 77 mm to 87 mm. Finally, the frame of the grid should be about 10 mm, while as wide as 15 mm. The grids should have a Shore D hardness value of approximately 72, and in the range of 55 to 82.

The cushioning wedge 32 and the cover 36 are preferably made from a low density polyurethane, EVA, or some other cushioning material with a Shore C hardness of approximately 50, but in the range of 47 to 53. The cover has a height of 2.2 mm, which may be as tall as 5.0 mm. The width and length of the cushioning wedge 32 and cover 36 should obviously be similar to the grids 20 and 34. The cushioning wedge 32 has a height of 2.0 mm on the medial side which increases to 12.4 mm on the lateral side. The height should be as tall as about 2.5 mm on the medial side and in the range of about 7 mm to 13 mm on the lateral side. The cushioning wedge 32 should support and be fully supported by the grid frames 40 and 42, respectively.

The midsole 22 should be made of a material that is less compressible than the cushioning wedge 32, but more compressible than the grid frames 40 and 42. Acceptable materials include resilient compressible material such as a microcellular filled closed cell foam, preferably a polyurethane (PU), an ethyl vinyl acetate (EVA), or a combination of the two materials. The preferable Shore C hardness value of the midsole material for PU is in the range of about 62 to 68 for the skin and approximately 35 for the core, while the EVA is preferably in the range of 53 to 59 after roughing the skin. This means that the total vertical thickness of the lateral side 82 and midsole region 80 is more compressible than the total vertical thickness of the medial side 84 and midsole region 86.

Having described this invention in detail, those skilled in the art will appreciate that numerous modifications may be made thereof without departing from the spirit of this invention. Therefore, it is not intended that the scope of this invention be limited to the embodiment illustrated and described. Rather, it is intended that the scope of this invention be determined by the appended claims and their equivalents.

We claim:

1. In a shoe construction with a heel region having a lateral and medial side, a stabilizing system, comprising:

at least one component extending laterally over at least a portion of the shoe construction from the medial side to the lateral side thereof in the heel region;

a cushioning wedge supporting said at least one component, said cushioning wedge having a lateral portion, medial portion, and center portion therebetween, said lateral portion being thicker than the medial portion and having greater compressibility than said medial portion;

and said center portion having a compressibility greater than both said lateral portion and said medial portion of said cushioning wedge thereby resisting pronation.

2. The stabilizing system as set forth in claim 1, further including means supporting said cushioning wedge along its periphery with said supporting means having a higher durometer than said cushioning wedge.

3. The stabilizing system as set forth in claim 2, wherein said at least one component comprises a grid, said grid having a grid frame and grid net, and wherein said grid frame provides at least in part said supporting means and defines an opening wherein said grid net is suspended.

4. The stabilizing system as set forth in claim 2, further including a sole assembly with components thereof extending below said supporting means and with the compressibility of the combination of the cushioning wedge, supporting means and sole components greater on the lateral than the medial side thereof.

5. The stabilizing system as set forth in claim 1, wherein said at least one component comprises a grid.

6. The stabilizing system as set forth in claim 1, wherein said cushioning wedge has a top surface and a bottom surface, said top surface and said bottom surface form an angle of 10°.

7. The stabilizing system as set forth in claim 2, wherein said cushioning wedge has a Shore C hardness value of about 50.

8. The stabilizing system as set forth in claim 1, further including a cover extending parallel and in vertical alignment with said at least one component.

9. The stabilizing system as set forth in claim 3, wherein said cushioning wedge has walls at least along said lateral and medial portions, said walls defining an open area in vertical alignment with said grid net.

10. The stabilizing system as set forth in claim 9, wherein said cushioning wedge has a top surface and a bottom surface, and wherein said grid is disposed on said top surface.

11. The stabilizing system as set forth in claim 10, including a second component, said second component being a second grid disposed on said bottom surface of said cushion wedge.

12. The stabilizing system as set forth in claim 1, wherein said cushioning wedge has a top surface and a bottom surface and said at least one component is disposed on said top surface.

13. The stabilizing system as set forth in claim 12, wherein a second component is disposed on said bottom surface.

14. The stabilizing system as set forth in claim 13, wherein said at least one component is a grid.

15. The stabilizing system as set forth in claim 1, wherein said cushioning wedge has a top surface, said top surface oriented in a plane substantially parallel to a running surface.

16. The stabilizing system as set forth in claim 15, wherein said cushioning wedge has a right angle triangle cross-section.

17. In a shoe construction, a heel assembly having lateral, medial, and center portions for controlling pronation and providing cushioning during running, comprising:

a plurality of vertically oriented components, the assembly having different material characteristics in the medial, center, and lateral portions of the heel, said components forming the lateral portion including a compressible material of one durometer and a medial portion including a compressible material of the same durometer but having less height, and the center portion being more compressible than the lateral and medial portions.

18. The stabilizing system as set forth in claim 17, wherein said compressible material includes an open area along said center portion.

19. The stabilizing system as set forth in claim 18, wherein said plurality of vertically oriented components include at least one grid.

* * * * *